US005478027A

United States Patent [19]

Alexander, III

[11] Patent Number: 5,478,027

[45] **Date of Patent: * Dec. 26, 1995**

[54] WEB UNWINDING APPARATUS AND METHOD

[75] Inventor: William J. Alexander, III, Mauldin, S.C.

[73] Assignee: Alexander Machinery, Inc., Mauldin, S.C.

[ * ] Notice: The portion of the term of this patent subsequent to May 11, 2010, has been disclaimed.

[21] Appl. No.: 375,518

[22] Filed: Jan. 18, 1995

Related U.S. Application Data

[63] Continuation of Ser. No. 140,972, Oct. 25, 1993, abandoned, which is a continuation of Ser. No. 981,859, Nov. 27, 1992, abandoned, which is a division of Ser. No. 816,173, Jan. 2, 1992, Pat. No. 5,209,418, which is a continuation of Ser. No. 615,408, Nov. 19, 1990, abandoned, which is a continuation of Ser. No. 349,328, May 8, 1989, abandoned, which is a continuation-in-part of Ser. No. 185,787, Apr. 26, 1988, abandoned, which is a continuation-in-part of Ser. No. 102,257, Sep. 29, 1987, abandoned, which is a continuation of Ser. No. 726,800, Apr. 24, 1985, abandoned.

[51] Int. Cl.[6] ..... B65H 16/10; B65H 19/30

[52] U.S. Cl. ..... 242/558; 242/563; 242/564.5

[58] Field of Search ..... 242/58, 58.6, 65, 242/66, 68.7, 75.1, 78.7, 558, 563, 564.5; 198/806, 807

[56] References Cited

U.S. PATENT DOCUMENTS

| | | | |
|---|---|---|---|
| 2,977,058 | 3/1961 | Hornstein et al. | 242/78.7 X |
| 3,223,344 | 12/1965 | Weymouth | 242/78.7 |
| 3,710,927 | 1/1973 | Alsted | 198/807 |
| 4,144,575 | 3/1979 | Schwarz | 242/75.1 |

FOREIGN PATENT DOCUMENTS

| | | | |
|---|---|---|---|
| 214760 | 4/1961 | Austria | 242/75.1 |

*Primary Examiner*—Joseph J. Hail, III
*Attorney, Agent, or Firm*—Ralph Bailey

[57] ABSTRACT

An apparatus is illustrated for unwinding a web, such as cloth or paper, which utilizes a driven belt having a width in excess of the width of the web forming a cradle for a cloth roll and the like with elements for adjusting the path of travel of the belt including at least one elongated oscillatable roll over which the belt passes and which is oscillated responsive to elements for sensing the position of the belt. The method contemplates doffing the core of the cloth roll by utilizing a vertically movable roll for tightening the belt while at the same time lowering one of a pair of spaced rolls supporting the cradle so that the core roll rolls off the belt and the belt is positioned for receiving a full cloth roll thereon prior to lowering of and cushioning by the movable roll to form the cradle in the belt. A pair of downwardly and inwardly tapering guide elements are provided spaced opposite respective ends of a tubular core for maintaining proper position of the web roll carried thereby.

5 Claims, 7 Drawing Sheets

WEB UNWINDING APPARATUS AND METHOD

This application is a Continuation of application Ser. No. 08/140,972 filed Oct. 25, 1993 now abandoned, which is a Continuation Ser. No. 07/981,859, filed Nov. 27, 1992 now abandoned, which is a Division of application Ser. No. 07/816,173, filed Jan. 2, 1992 now U.S. Pat. No. 5,209,418, which is a Continuation of Ser. No. 07/615,408, filed Nov. 19, 1990 now abandoned, which is a Continuation of Ser. No. 07/349,328, filed May 8, 1989 now abandoned, which is Continuation-in-Part of Ser. No. 07/185,787 filed Apr. 26, 1988, now abandoned, which is a Continuation-in-Part of Ser. No. 07/102,257 filed Sep. 29, 1987, now abandoned, which is a Continuation of Ser. No. 06/726,800, filed Apr. 24, 1985 now abandoned.

BACKGROUND OF THE INVENTION

Apparatuses for unwinding rolls of cloth supported between two rolls have been known as dewinders, and it is generally recognized that unwinding a roll of cloth in open width or at least with minimal folds so as to be considered in open width presents more problems than winding the cloth in the first instance. In the textile industry, it is often desirable to unwind rolls of cloth as for inspection or for further processing as in dyeing, or otherwise, finishing the cloth. The fabric tends to loosen in the outer layers causing the fabric to bunch up at the nip or contact point between the fabric roll and the driven roll or rolls. Similar problems are presented in the paper industry where rolls of paper are unwound. Other webs which are being unwound in open width present analogous problems.

A center wind unwinder is illustrated in U.S. Pat. No. 3,900,063 while a surface unwinder utilizing a belt forming a cradle between two rolls for accommodating a cloth roll is illustrated in Austrian Patent No. 228,151 of 1963. This Austrian Patent illustrates structure utilized in attempting to solve a belt tracking problem by utilizing endless V-shaped belt portions carried across the underside of the cradle forming belt with corresponding grooves in the rolls carrying the belt. It has been found, however, that such structures are ineffective in dealing with heavier cloth rolls which often weigh as much as 4,400 pounds and are 50 inches in diameter. An application of the belt and cradle arrangement to the paper industry is illustrated in U.S. Pat. No. 2,977,058. Other attempts to provide dewinders utilizing a cradle arrangement forming belt have included other uses of V-belts spaced longitudinally across the back of the cradle forming belt but such arrangements have been practical only with very light rolls and do not effectively solve the problem of guiding the cradle forming belt.

Accordingly, it is an important object of this invention to provide a dewinder utilizing surface unwinder principles and a cradle forming belt extended between spaced level rolls which provide guide means for assuring proper tracking of the cradle forming belt together with effective means for doffing an empty core roll and placing a full roll of cloth and the like upon the cradle forming belt for unwinding.

Another important object of the invention is to provide guide means for maintaining the tubular roll in proper transverse alignment upon the belt.

SUMMARY OF THE INVENTION

It has been found that effective guide means may be provided for assuring proper tracking of a cradle forming belt for use in a dewinder by positioning a guide roll beneath spaced level cradle supporting rolls, The guide roll is oscillatable to provide movement along its length changing the angle at which the belt is passed thereover for exerting a guiding force on the belt across its width, A method of dewinding includes the doffing of a core roll by tightening the cradle forming belt while at the same time lowering one of the spaced level rolls supporting cradle. While the belt supporting roll is lowered a new roll of web material may be passed thereover and placed between the belt supporting rolls and the belt loosened for forming a cradle, It is desirable that tightening and loosening of the belt be accomplished by utilizing a transverse roll which may be moved up and down by pneumatic cylinders located at each end so that the cylinders may act as shock absorbers when the newly web roll is placed upon the belt forming the cradle, When the core roll is doffed it rolls down over the lowered belt supporting roll and falls downwardly through a space between the lowered supporting roll and a cloth roll supporting table. When the full roll is placed on the belt a side abutment portion of the table is lowered bridging the space and permitting a full cloth roll, previously restrained thereby, to roll thereover on to the belt between the belt supporting rolls.

An upright inwardly and downwardly tapering guide means is provided opposite each end of the tubular core for contact with the bottom of the tubular core in order to maintain proper transverse alignment. The guide means are movable in and out and are movable vertically by an upward movement on the pivotal arms which carry same out of the way during doffing and replacement with a full web roll.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

The drawings illustrate apparatus for unwinding a web from a web roll having a driven belt with a width in excess of the width of the web supported between a pair of spaced transverse upper belt supporting rolls forming a cradle for supporting the web rolls and for unwinding the web therefrom. At least one transverse aligned lower roll is provided for passage of the belt thereabout. A mounting A is provided for guiding an end of the lower roll for oscillatory movement in a predetermined path. Power operated means B move the end of the lower roll for oscillating movement in the predetermined path. Sensing means C are actuated by the belt for controlling the power operated means adjusting the position of the mounting for guiding the belt. A movable roll D is positioned beneath the spaced transverse belt supporting rolls in alignment therewith raisable and lowerable to tighten and to loosen the driven belt. A fluid operated cylinder E is provided for raising and lowering the movable roll. Means F are provided for lowering one of the spaced transverse upper rolls with respect to the other. Thus, placing of a full web roll on the belt may be facilitated by lowering said one of the spaced transverse rolls while tightening said belt against the force of the cylinder by moving the movable roll.

Figure 1:
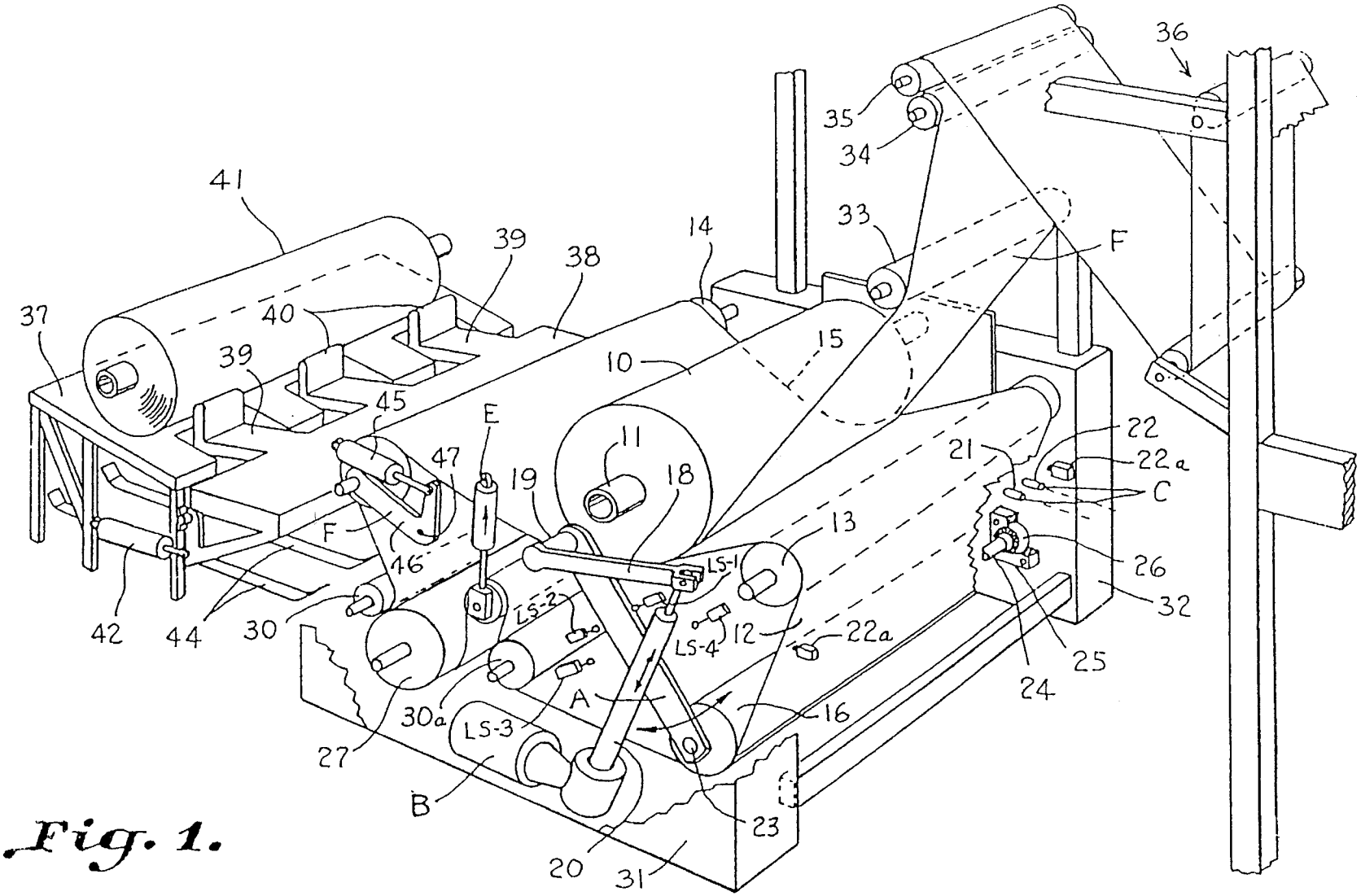
FIG. 1 is a perspective view looking toward the front right-hand side of dewinding apparatus constructed in accordance with the invention with the cloth being fed to an inspection machine.
Figure 2:
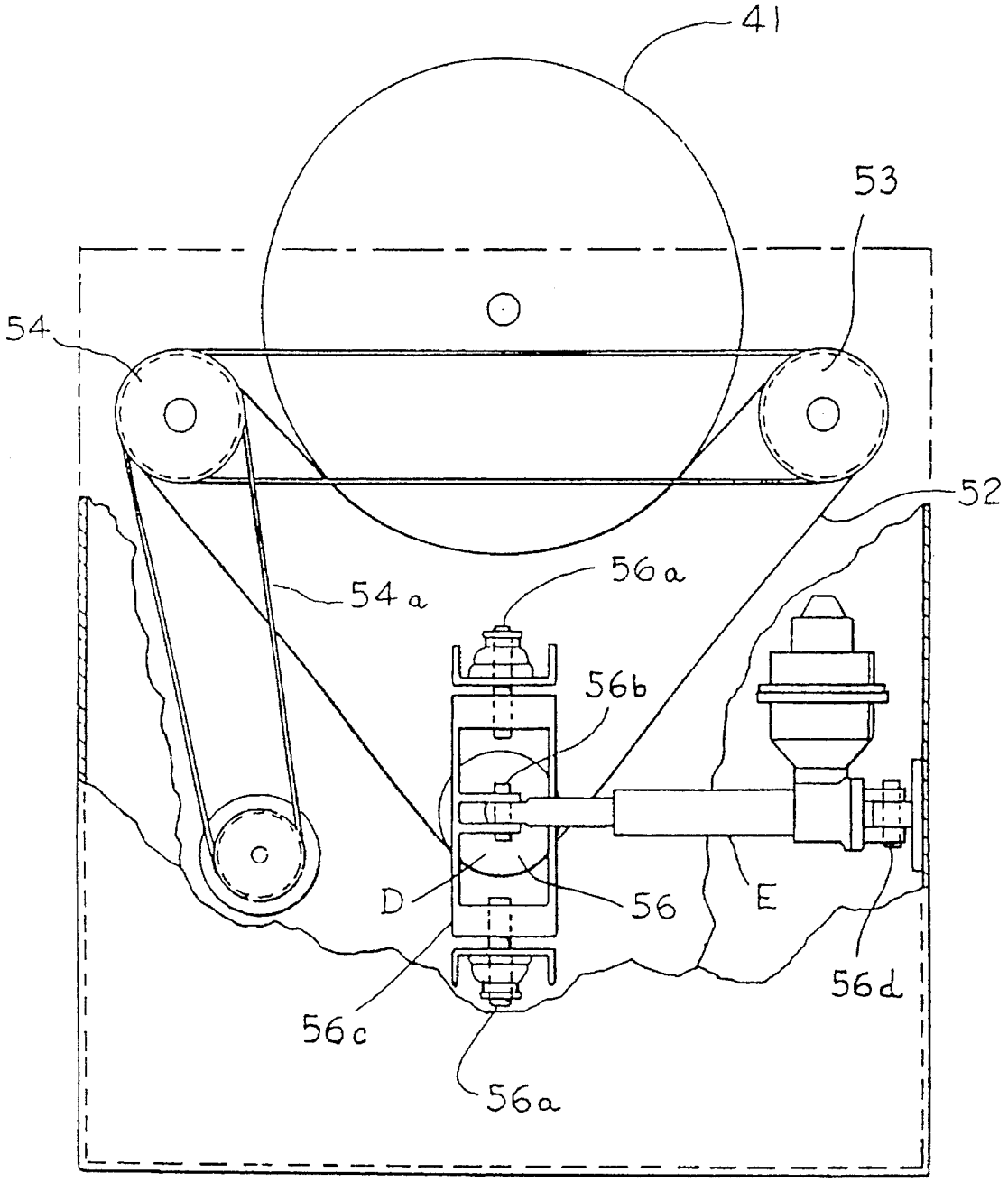
FIG. 2 is an end view of an alternate embodiment of the apparatus of this invention.

One embodiment of the apparatus for unwinding a web in the form of cloth F from a roll 10 having a core 11 is illustrated in FIG. 1. While the invention is described in an embodiment suitable for use in unwinding cloth rolls, it is to be understood that the invention is useful with suitable apparatus for unwinding any other web material as in open width. The dewinder has a driven belt 12 which is supported between a front roll 13 and a rearwardly spaced roll 14. The driven belt 12 has a width in excess of the width of the web F which is supported between the pair of spaced upper rolls 13 and 14 forming a cradle 15. The rolls 13 and 14 are preferably substantially level. At least one transverse aligned lower roll 16 is provided with a mounting A for guiding an end of the roll for oscillatory movement in a predetermined path. The embodiment illustrated in FIG. 1 has two lower rolls 16 and 27. The alternate embodiment has only one lower roll 56 which is also provided with a pivotal mounting for oscillatory movement.

Referring to FIG. 1, the mounting A includes a pivoted arm 17 which has fixed connection with a crank arm 18 through a fixed offset arm 19. A power operated extensible member 20 is actuated by a motor B. The operation of the motor B is controlled by sensors C which, in this instance, are operated on a go or no go basis responsive to passage of the edge of the belt 12 thereover. If the belt extends over the first or innermost of the sensors 21 and is operated within the neutral band between the sensors 21 and 22, then no movement of the roll is required or indicated. However, should the sensor 21 become uncovered then a signal resulting in movement of the belt to the right toward the neutral position is called for and likewise, covering of the sensor 22 calls for movement in the opposite direction.

Oscillatory movement of the roll 16 is accomplished in an arcuate path illustrated by the arrow adjacent the crank arm 17 which carries the roll for rotation in a bearing 23. A self-aligning bearing supports a stub shaft 24 at the other end of the roll 16 and a fixed outer spherical housing 25 carries an inner race 26 therein which carries suitable anti-friction bearings for carrying the roll 17 for rotation. The belt 12 is driven and supported by an additional transverse lower roll 27 which is driven by the motor 28 through a belt 29, see FIG. 3. The belt 12 is maintained in proper tension by the roll 30 which serves as a guide for the belt. The roll **30*a* together with the roll 27 supports the belt for tightening and loosening the belt 12** by raising and lowering the roll D by the fluid operated cylinder E.

Instead of moving an oscillatable end of the roll in an arcuate path as shown if two rolls are used they may be skewed in respect to each other for guiding. Any other suitable roll guiding means for the belt may be employed where the guiding action may be effected along the length of the roll. The arcuate path illustrated requires the arcuate cut out **31*a*** in the adjacent frame member.

The rolls described above are carried for rotation within side frame members 31 and 32 and the fabric F is fed from the roll 10 over a roll 33 and thence between rolls 34 and 35 preparatory to being fed into an inspection machine broadly designated at 26.

In FIGS. 1, 3, 4 and 5, roll D is movable up and down in order to tighten and loosen the belt 12. This is accomplished through the use of a cylinder E which may be fixed to the frame members 31 and 32.

Figure 3:
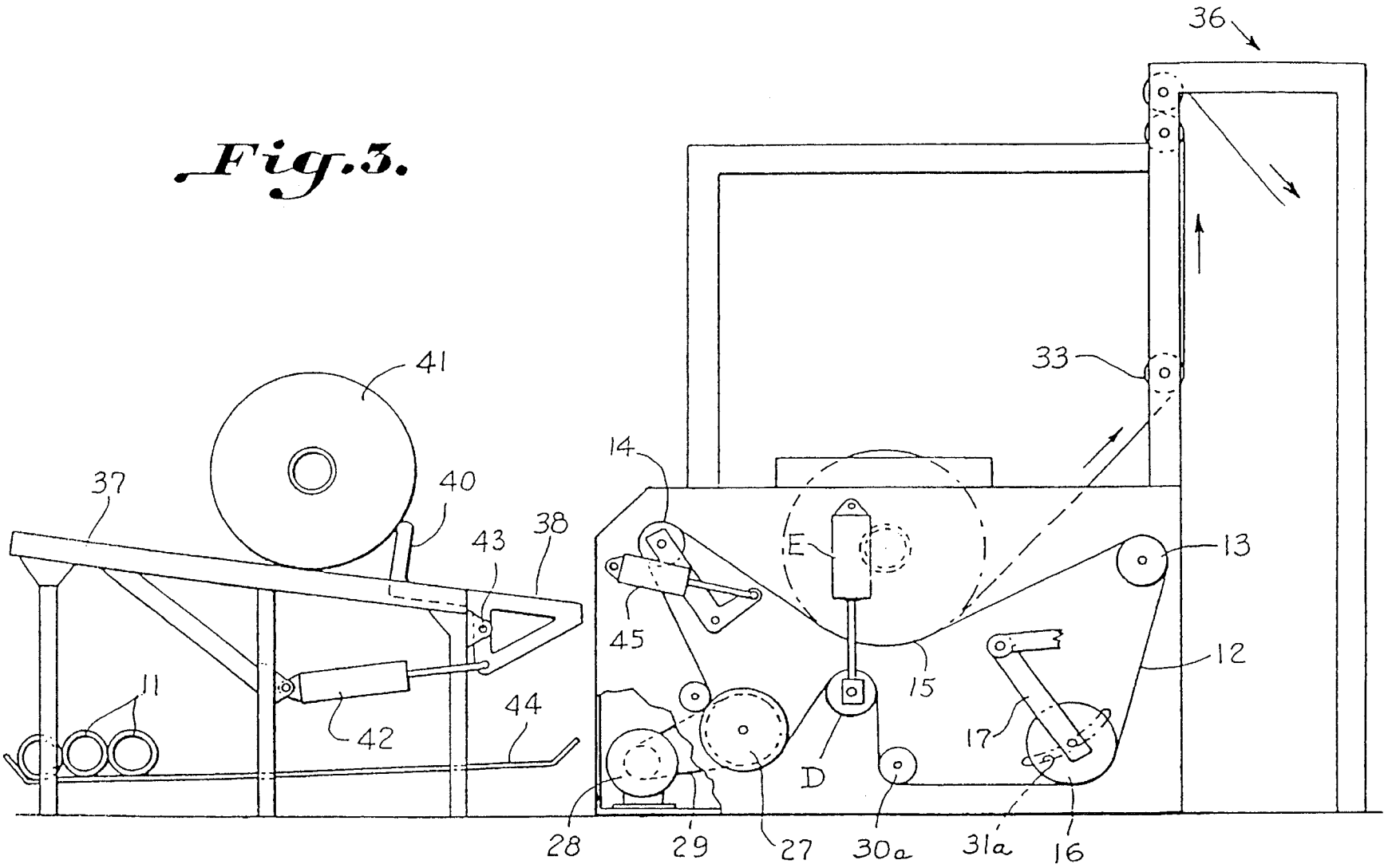
FIG. 3 is a side elevation illustrating a cloth roll supporting table with apparatus useful in doffing the core roll and for placing a full cloth roll upon the dewinder cradle forming belt while feeding cloth to an inspection machine illustrating the step of dewinding the cloth.

A table has a rearward support area 37 which carries a tiltable gate or bridging member 38 at its forward edge to serve as an abutment to restrain a full cloth roll in position on the table against the tendency for the cloth roll to roll toward the dewinder. The gate has interleaved portions 39 which carry upturned ends 40 for restraining a cloth roll 41. The gate 38 is normally raised as shown in FIG. 3 to support a cloth roll but is lowerable by actuation of the pneumatic cylinder 42 to lower the gate 38 about the pivot 43. When this has been accomplished the core roll 11 rolls downwardly as in FIG. 4 where it is caught by elongated longitudinally members 44 preparatory to lowering of the gate 38 to the position shown in FIG. 5. When the cloth roll has been rolled onto the belt 12, the roll D is lowered against the force of the cylinder to form the cradle 15.

Figure 4:
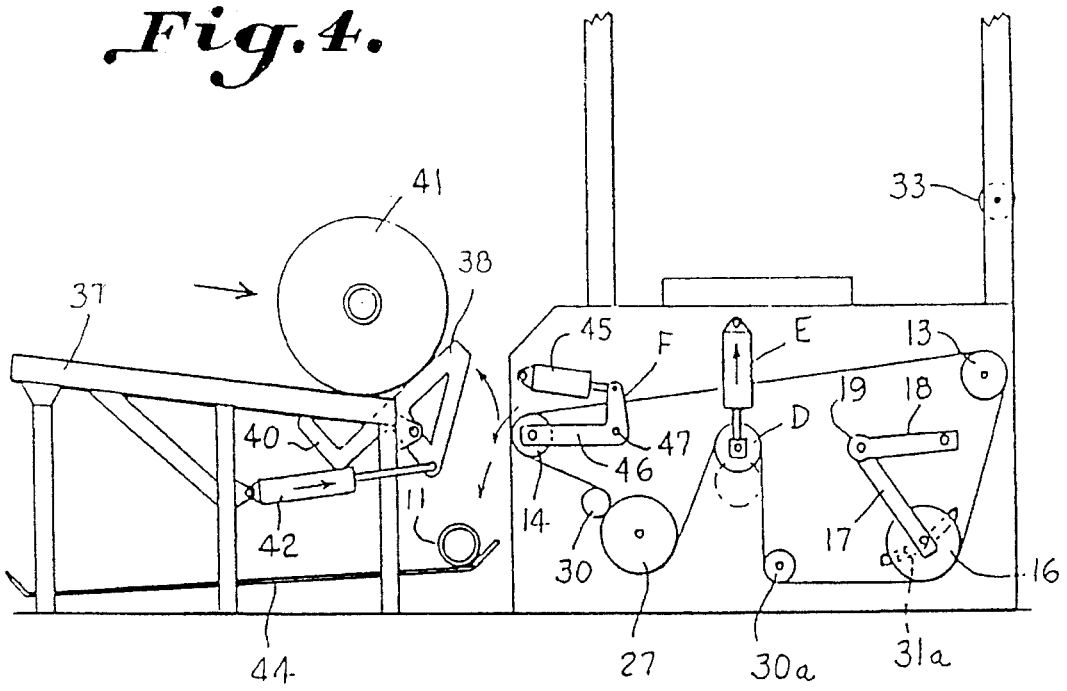
FIG. 4 is a side elevation similar to FIG. 3 illustrating the support for the cloth roll and the dewinder with the cradle forming belt tightened while doffing the core roll.
Figure 5:
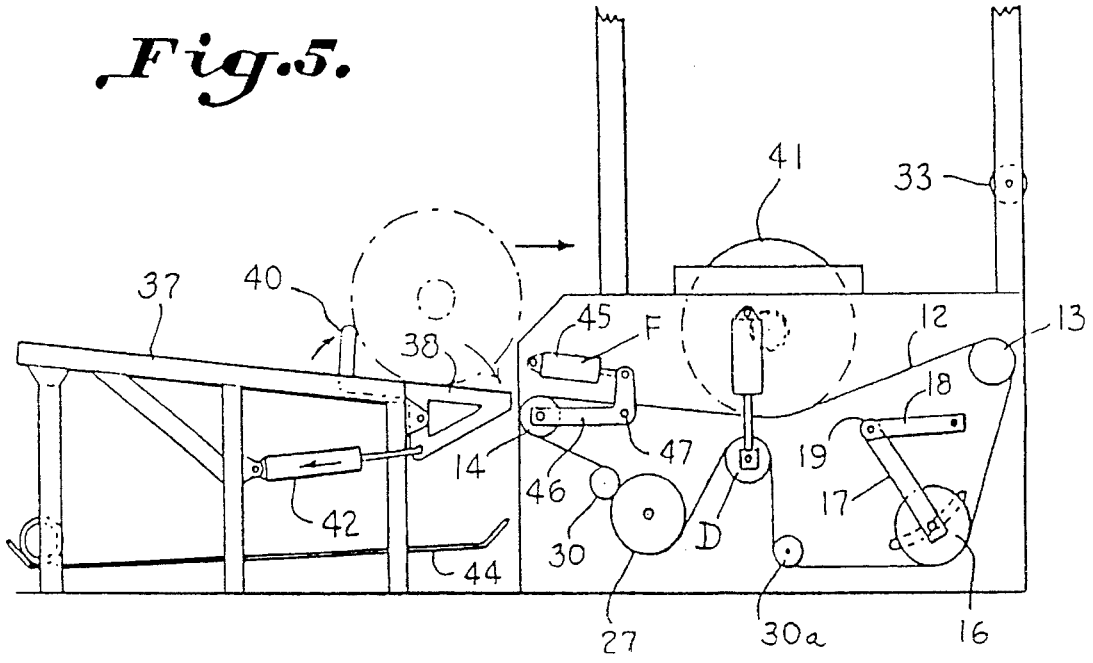
FIG. 5 illustrates the dewinder having received a full roll of cloth.

FIG. 3 illustrates the apparatus in running position with cloth F being unwound and fit to the inspection machine 36. The full roll 41 is restrained by the upturned ends 40. FIG. 3 illustrates doffing of the core 11. This is accomplished by tightening the cradle forming belt 12 as described above and lowering the roll 14 by the action of the cylinder 45 upon the bell crank arms 46 which are pivoted on the frames 31 and 32 at 47. In FIG. 4 the upturned ends 40 are lowered and the cloth roll 41 received upon the gate or bridge 38. In FIG. 5 the cloth roll 41 has passed over the bridge 38, over the lowered roll 14 and acts against the cushioning force of the cylinder E to form a cradle for unwinding the cloth roll.

OPERATION

Figure 6:
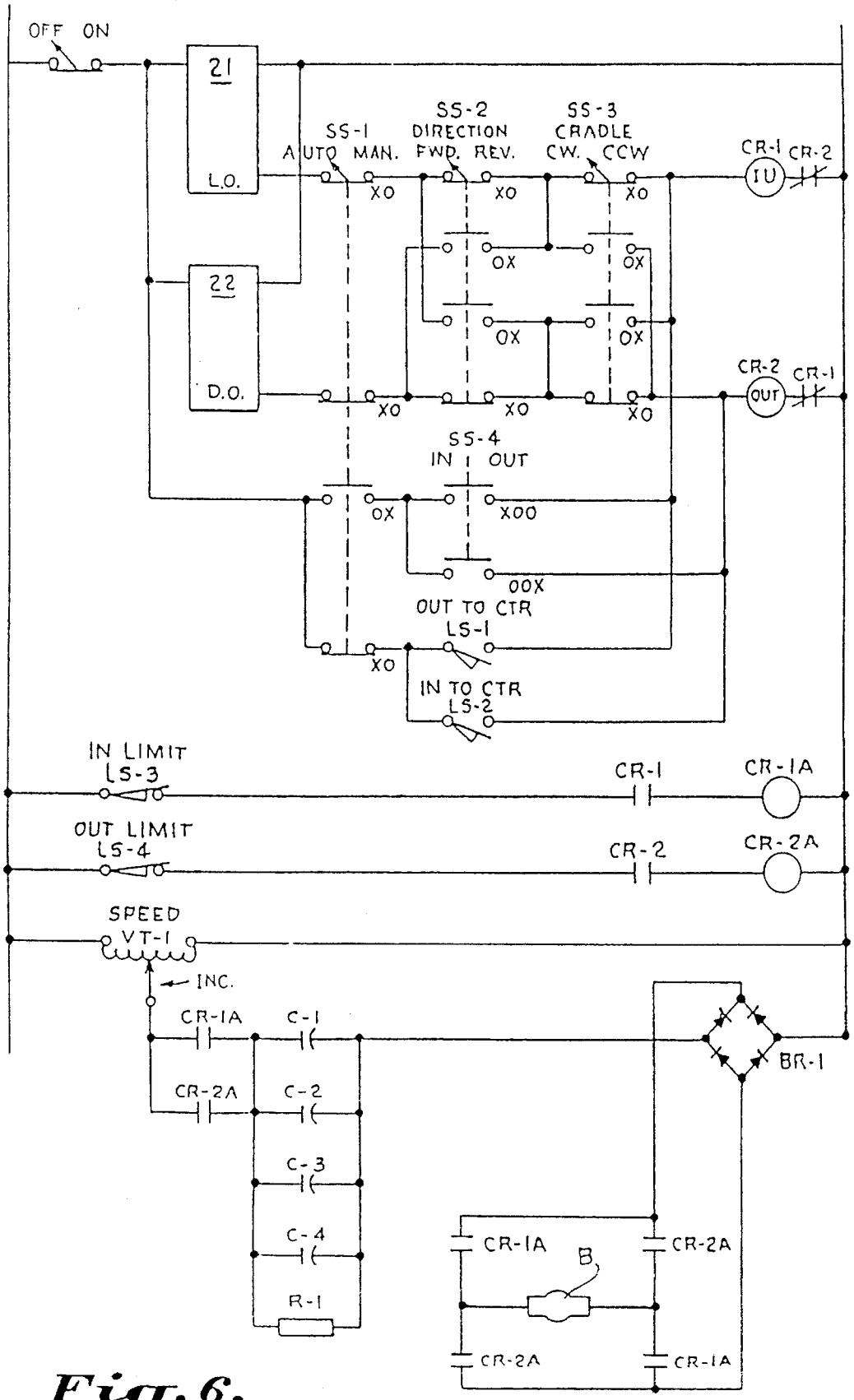
FIG. 6 is a schematic diagram illustrating electrical sensing controls for guiding the belt.

The photocell 21 is light operated as illustrated in FIG. 6. When belt 12 moves out of the light beam the CR-1, the relay CR-1 contacts close and pickup a mercury relay CR-1A. This starts the motor B which will operate until the arm 17 contacts limit switch LS-3 or belt moves back into the light beam. As long as the photocell 21 sees light, the arm 17 will stay in the extreme travel direction and hold the switch LS-3 open. When the belt moves back into beam, the control relay CR-1 drops out which now disables the mercury relay CR-1A. Since the arm 17 has moved out of the center, it has also closed the limit switch LS-2 which is the in position for effecting center control. This limit switch will operate control relay CR-2 which controls the mercury relay CR-2A. Due to normally closed interlocks across both control relays CR-1 and CR-2 only one relay may be energized at any time. The limit switch LS-2 will pick up the relay CR-2 and mercury relay CR-2A and reverse the motor B. The arm will move until the limit switch LS-2 opens which drops out relays CR-2 and CR-2A. The arm 17 has now returned to center position. The photocell 22 is dark operated. Should the belt 12 move into and break the beam of the photocell 12, it would operate the relays CR-2 and CR-2A. As the arm 17 moves to the out position it also closes the limit switch LS-1 (out position to center). The operation is thus the same as outlined above. If desired, additional sensors 22*a* may be provided on each side of the belt in case of failure of the above system in order to prevent damage from extreme positions of the belt 12 resulting from misalignment thereof.

The drive mechanism is a speed-torque drive and operates the same as that explained in U.S. Pat. No. 3,221,237. The transformer VT-1 controls speed of the motor B. The AUTO-MAN switch SS-1 enables fully automatic control of belt guiding or such may be placed in manual position and controlled from switch SS-4 in-out.

Thus, proper tracking of the belt 12 is assured by moving a guide roll over which the belt passes along a predetermined path to vary the angular relationship between the guide roll and the belt responsive to a signal indicative of the movement required to correct any misalignment. The guide roll is moved along a predetermined path to vary such angular relationship and returned along that path after positioning of the belt.

In FIGS. 2, 7, 8 and 9 the lower roll 56 is laterally oscillatable about a pivot 56*a* which may be located midway of the length of the roll. The tracking of the belt 52 is controlled through oscillation of the roll 56 responsive to the linear actuator E which is pivotally connected as at 56*b* to the longitudinal frame 56*c* within which the roll 56 is mounted for rotation. The linear actuator is pivoted as at 56*d* opposite pivot 56*b* to the machine frame. The frame 56*c* is pivoted about the pivot point 56*a*, skewing the roll horizontally. Skewing of the roll 56 as thus described causes the belt 52 to move longitudinally along the rolls 53 and 54 as required for exerting a guiding action upon said belt in such a path as to stretch the belt substantially the same amount at each side thereof, although the length of the belt itself does not change. The rolls 54 and 53 are driven by the belt 54*a*. The lower roll 56 is mounted beneath and midway between the upper rolls 53 and 54 and is oscillated in a linear horizontal path. The guide rolls 16 and 56 should be positioned, to have a belt wrap of less than 180° since more tends to reduce its effectiveness in guiding.

Figure 7:
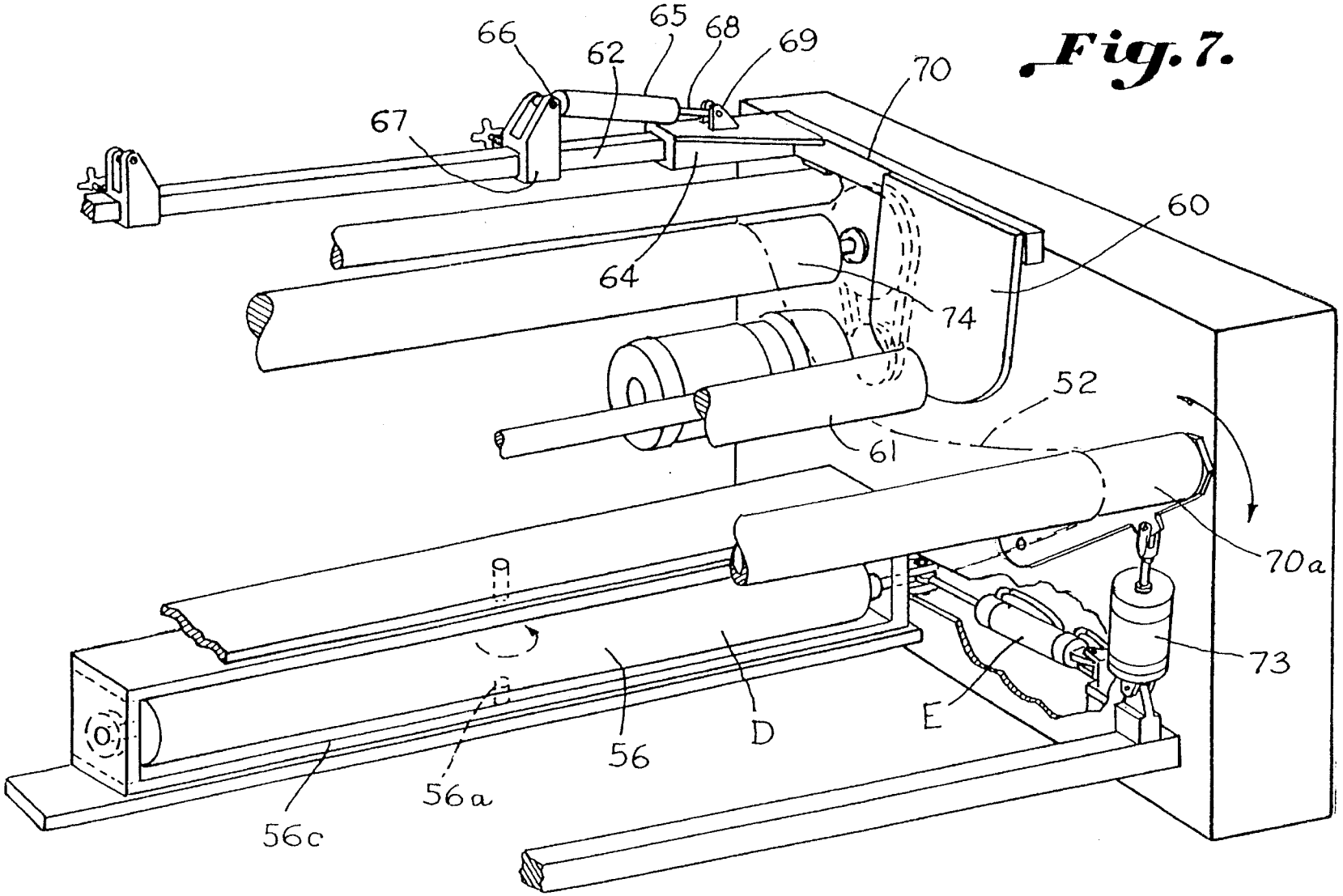
FIG. 7 is a perspective view illustrating the mounting for the guide means for maintaining lateral alignment of the web roll.
Figure 8:
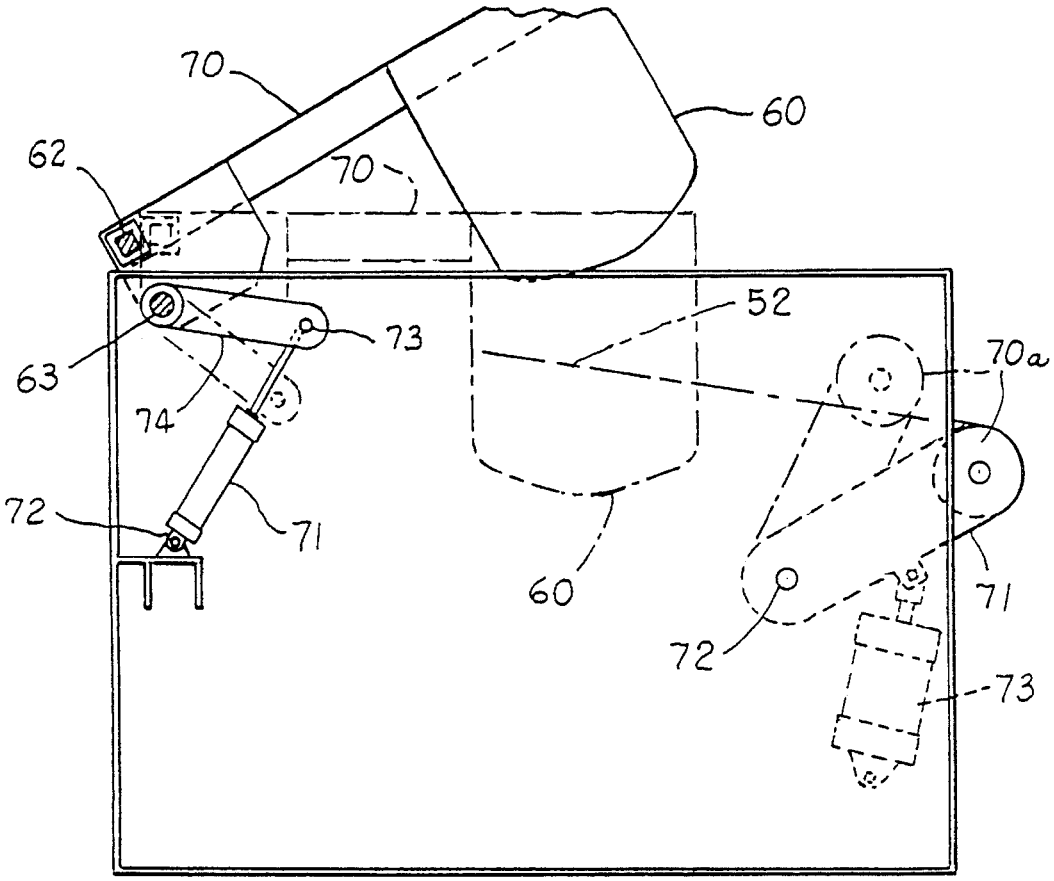
FIG. 8 is a transverse sectional elevation illustrating the position of the belt and core guide for doffing and replacing a full web roll.
Figure 9:
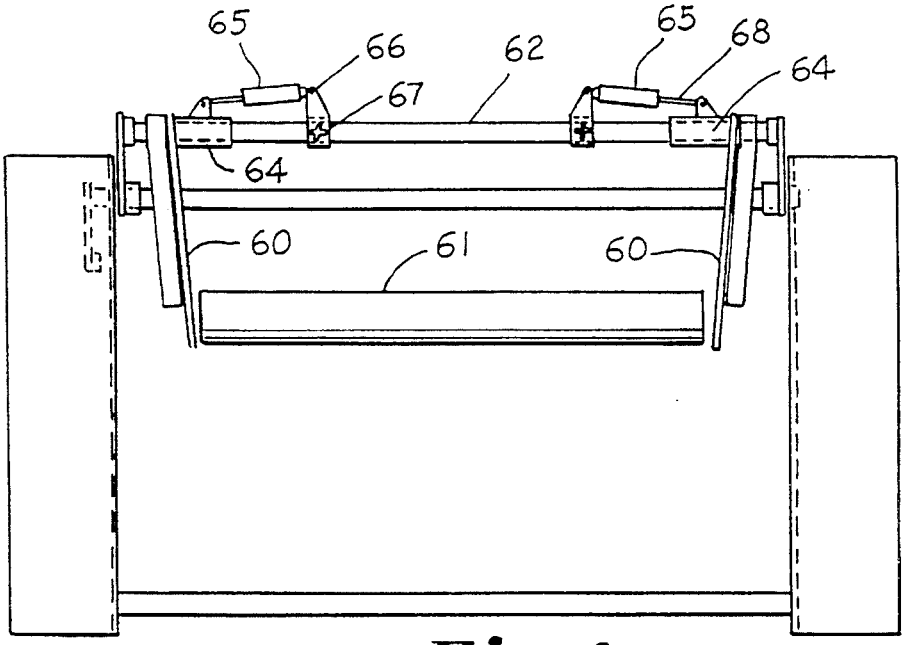
FIG. 9 is a front view illustrating the downwardly and inwardly relation between the core guide and the core tube.

A guide is illustrated in FIGS. 7, 8 and 9 which include a pair of upright core engaging members 60 spaced to accommodate the full length of a core 61 as illustrated in FIG. 9 therebetween. The upright core engaging members 60 thus engage only a lower edge of the tubular core 60 so as to prevent the end from walking or becoming cocked out of transverse alignment. It should be noted, however, that adequate spacing between members 60 avoid all contact with the core 61 except when the core moves too far to one side or the other and then contact only takes place on one side and at the bottom of the core.

Means are provided for carrying each of the upright core engaging members for movement in and out for engagement with a respective end of the core and include a transverse rod 62 which is pivotally mounted at one end at 63 as shown in FIG. 8. The core guides 60 are carried upon a slide member 64 which is slidable upon the bar 60 responsive to an extensible member such as the cylinder 65. The cylinder 65 is pivotally mounted on one end as at 66 upon an adjustable mounting 67 which may be adjusted to accommodate a web of any given width. The piston rod 68 has pivotal connection as at 69 upon the slide 64. An arm 70 connects the slide 64 and serves as a part of the mounting supporting the upright guide members 60. The means raising the guide members out of the way includes an extensible member including a cylinder 71 which is pivoted on one end as at 72 to a fixed member. The end of the extensible piston rod is pivoted as at 73 to a link 74 which raises the arm 70 above at a pivot point 63 moving the core guide out of the way.

If desired, the core guides may simply be moved laterally outwardly sufficiently to accommodate doffing and replacement of the web rolls. During the doffing operation, the belt carrying rolls are pivoted outwardly and downwardly as illustrated herein in order to tighten the belt and accommodate the used core being removed and the full web roll being moved into position. The upper roll 70 may be carried by a link 71 and pivoted downwardly to tighten the belt 52 to facilitate doffing responsive to the cylinder 73. The driven roll 74 is in fixed position.

While a preferred embodiment of the invention has been described using specific terms, such description is for illustrative purposes only, and it is to be understood that changes and variations may be made without departing from the spirit or scope of the following claims.

What is claimed is:

1. Apparatus for unwinding a web from a web roll comprising:

a stationary frame having spaced upright sides;

a pair of substantially parallel horizontal upper rolls mounted for rotation on said stationary frame supported substantially entirely between said upright sides during unwinding and being spaced one on each side of said web roll between said upright sides;

at least one lower guide roll spaced below said pair of upper rolls and in substantially parallel alignment therewith;

an endless belt passing about said spaced upper rolls forming a cradle therebetween supporting substantially the entire weight of said web roll during unwinding and extending downwardly over each of said upper rolls forming a loop portion thereabout and engaging said lower guide roll maintaining said cradle between said upper rolls supporting said web roll continuously during unwinding;

means driving said endless belt for unwinding said web from said web roll;

a mounting for guiding said lower guide roll for oscillatory movement of at least one end thereof in a predetermined path for exerting a guiding action upon said belt;

power operated means moving at least one end of said lower guide roll for oscillatory movement in said predetermined path for guiding said belt by engagement with said loop portion to exert a force maintaining proper tracking of the belt;

means sensing the position of said belt for actuating said power operated means oscillating said lower guide roll for maintaining said proper tracking of the belt; and means limiting lateral movement of said web roll on said belt during unwinding.

2. The structure set forth in claim 1 wherein said lower guide roll supports said belt by engaging an inner surface of said loop extending about said rolls.

3. The method of unwinding a web from a web roll comprising the steps of:

unwinding the web roll;

supporting substantially the entire weight of said web roll, during unwinding, on a cradle formed by an endless belt extending about a pair of horizontal upper rolls spaced one on each side of said web roll in substantially fixed parallel relation thereto during unwinding;

maintaining said upper rolls in a generally horizontal plane positioning said cradle therebetween during unwinding;

providing at least one lower roll spaced below said pair of aligned horizontal upper rolls and in substantially parallel alignment therewith;

forming a loop in said endless belt having a portion passing about said spaced upper rolls forming said cradle and extending downwardly over each of said upper rolls and passing about said lower roll;

driving said endless belt for unwinding said web from said web roll;

providing power operated means guiding said belt;

exerting a force by said power operated means;

maintaining proper tracking of the belt by exerting said force by said power operated means;

sensing the position of said belt;

actuating said power operated means for maintaining proper tracking of the belt responsive to the position of said belt; and limiting lateral movement of said web roll on said belt during unwinding.

4. Apparatus for unwinding a web from a web roll comprising:

a stationary frame having spaced upright sides;

a pair of substantially parallel horizontal upper rolls mounted for rotation on said stationary frame supported substantially entirely between said upright sides and spaced one on each side of said web roll between said upright sides;

a lower roll spaced below said pair of upper rolls and in substantially parallel alignment therewith;

an endless belt passing about said spaced upper rolls forming a cradle therebetween supporting substantially the entire weight of said web roll during unwinding and extending downwardly over each of said upper rolls forming a loop portion thereabout engaging said lower roll;

said pair of upper rolls being mounted for rotation in substantially the same generally horizontal plane during unwinding;

means driving said endless belt for unwinding said web from said web roll;

means guiding said belt by engagement with said loop portion exerting a force maintaining proper tracking of the belt including power operated means moving at least one end of said lower roll in a predetermined path;

means sensing the position of said belt and for actuating said power operated means for maintaining proper tracking of the belt; and means engaging said web roll at respective ends limiting lateral movement of said web roll on said belt during unwinding.

5. The structure set forth in claim 4 wherein said web roll is carried on a roll core, and including means pivoting one of said pair of upper rolls outwardly and downwardly after unwinding is completed to facilitate removal of said roll core.

* * * * *